United States Patent [19]

Parker

[11] 4,319,594

[45] Mar. 16, 1982

[54] COMBINATION TOILET ARTICLE

[76] Inventor: Donald K. Parker, Box 125, Chandler Heights, Ariz. 85227

[21] Appl. No.: 165,749

[22] Filed: Jul. 3, 1980

[51] Int. Cl.[2] ..... A45D 24/00

[52] U.S. Cl. ..... 132/11 R; 132/121

[58] Field of Search ..... 132/11 R, 120, 121, 132/147, 155, 136

[56] References Cited

U.S. PATENT DOCUMENTS

| | | | |
|---|---|---|---|
| 1,196,959 | 9/1916 | Lawerenz | 132/120 |
| 2,160,618 | 5/1939 | Kreutzig | 132/120 |
| 2,473,227 | 6/1949 | Solomon | 132/120 |
| 2,513,853 | 7/1950 | Fabis | 132/147 |

*Primary Examiner*—G. E. McNeill

*Attorney, Agent, or Firm*—Don J. Flickinger

[57] ABSTRACT

A brush is detachably engageable with a hair grooming device, such that the handle of the brush forms an integral part of the backbone of the grooming device. A pair of lugs, each having a socket formed therein and extending upwardly from the backbone, matingly receive the ends of the handle. A wall formed in the backbone receives a cluster of bristles depending from the lower edge of the handle.

8 Claims, 5 Drawing Figures

COMBINATION TOILET ARTICLE

FIELD OF THE INVENTION

This invention relates to toilet articles.

In a further aspect, the present invention relates to toilet articles of the type for attending to the hair and to the teeth.

More particularly, the instant invention concerns an improved combination toilet article especially adapted to be carried in a pocket or purse.

DESCRIPTION OF THE PRIOR ART

Brushes and combs are two personal toilet articles for which there is frequent need. While combs are generally considered to be hair grooming devices, brushes serve a variety of needs. Brushes of various types are used, for example, to remove lint from clothing, cleanse the teeth, and attend to the hair.

The toothbrush is exemplary of a toilet article for which there is frequent periodic need. Dental hygiene recommends that teeth be brushed after each meal to reduce the occurrence of cavities and prevent degeneration of the gums. Brushing the teeth is also desirable for cosmetic purposes to remove unsightly deposits and freshen the mouth and breath.

The hair requires similar periodic attention, especially for appearance reasons. Coiffeurs have a tendency to deterioriate with the passage of time. Certain phenomenon, such as physical activity or blowing wind, can quickly dishevel a hair arrangement.

Attention to the hair, teeth or other need requiring a comb or a brush is relatively easily accomplished at one's personal toilet within the home where an assortment of toilet articles, especially adapted for specific purposes, is readily available. Many persons, however, have reason to be absent from the home for extended periods from the purposes of attending to daily routines or travel. Accordingly, the task of attending to such personal needs is rendered difficult if not impossible.

In recognition thereof, the prior art has provided various toilet articles intended to be carried upon the person. Especially well known is the conventional pocket comb. A search of records within the U.S. Patent and Trademark Office to reveal other prior art devices related to the present invention, revealed the following U.S. Pat. Nos.:

1,059,537, Hanson;
1,196,959, Lewerenz;
2,191,254, Harmon;
2,585,561, Lattuca;
1,061,831, Freese;
1,210,011, Siesholtz;
2,237,611, Motley;
2,815,032, Rosenfeld.

U.S. Pat. No. 1,059,537 discloses a toilet article including a comb having a hollow back forming a pocket for receiving a toothbrush. A closure at one end of the pocket is handled in place by means of a flat leaf-spring.

U.S. Pat. No. 1,061,831 discloses a combination comb and toothbrush holder comprising a comb and a tubular toothbrush holder secured to its back. The open end of the tubular holder is closed by a stopper.

U.S. Pat. No. 1,196,959 discloses a combination comb and toothbrush holder including a comb, the back of which is provided with a longitudinally extending chamber in which a toothbrush is placed and which is provided with a flared mouth. The handle of the toothbrush is provided with a tapered head which becomes wedged in the flared mouth when the toothbrush is placed in the chamber.

U.S. Pat. No. 1,210,011 discloses a comb molding having a recess for receiving the back of a comb. The molding includes several compartments, each provided with a side opening and closed by means of a cover.

U.S. Pat. No. 2,191,254 discloses a vanity comb having a tubular compartment extending along approximately one-half of the length of the back. A fingernail file, the shank of which is secured within the end of the tubular compartment, extends along the balance of the back.

U.S. Pat. No. 2,237,611 discloses a combined receptacle and comb having a tubular article retaining receptacle having a screw cap at one end thereof, which is attached to the back of a comb by pins.

U.S. Pat. No. 2,585,561 discloses a receptacle comb, which in accordance with one embodiment, has a back which is hollowed out to provide a receptacle and a hingedly mounted lid as a closure for the receptacle. In accordance with another embodiment of the invention, the comb has an extending removable handle which is hollowed to provide the receptacle.

U.S. Pat. No. 2,815,032 discloses a combination toilet device including a comb with an extending handle. A brush part is provided with a sheath-like recess for receiving the comb. The handle is formed with a bore for receiving a lipstick.

For various reasons, which will be apparent to those skilled in the art by a comparison of the prior art with the following objectives of the invention, the prior art has not provided an entirely adequate solution to certain problems.

Accordingly, it is an object of the present invention to remedy the inherent deficiencies of the prior art and provide an improved combination toilet article.

Another object of the invention is the provision of a combined hair grooming device and brush.

Still another object of the invention is to provide a combination toilet article especially adapted to be carried on the person.

Still another object of this invention is the provision of a combination device in an exceedingly compact, streamlined configuration to be readily carried in a pocket or purse.

Yet another object of the invention is to provide a combination device in which the handle of the device forms an integral part of the backbone of the hair grooming device.

And a further object of the invention is the provision of a combination toilet article in which the brush is easily and readily attachable to and detachable from the hair grooming device.

Still a further object of the instant invention is to provide a device of the above type in which the hair grooming device may assume various configurations.

Yet a further object of the invention is the provision of a combination toilet article having a brush which may be selected for various specific uses.

And still a further object of the invention is to provide a device as above which is relatively inexpensive to manufacture, substantially durable and convenient to use.

SUMMARY OF THE INVENTION

Briefly, to achieve the desired objects of the instant invention in accordance with a preferred embodiment thereof, first provided is a hair grooming device having an elongate backbone with a plurality of hair engaging elements depending therefrom. Next provided is a brush including an elongate handle from which extends a plurality of bristles arranged in a cluster. Means for detachably securing the brush to the hair grooming device includes a well in the backbone of the hair grooming device for receiving the bristles of the brush and engagement means for detachably affixing the handle element to the backbone.

In accordance with a further embodiment of the invention the engagement means includes a pair of spaced apart lugs upstanding from the upper longitudinal edge of the backbone. A pair of opposed sockets are formed in the lugs for matingly receiving respective ends of the handle element. A tab, projecting from the handle element, is received within a recess formed in the backbone to prevent lateral movement of the handle element. The device may also include a pick element carried in a receptacle within the handle element of the brush.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings, in which.

DESCRIPTION OF THE PREFERRED EMBODIMENTS

Figure 1:
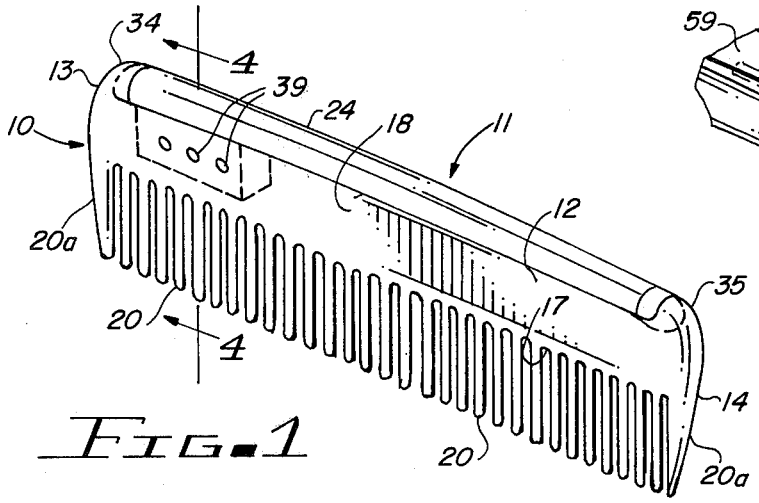
FIG. 1 is a perspective view of a toilet article combining a hair grooming device and a brush and embodying the teachings of the instant invention.

Turning now to the drawings in which like reference characters indicate corresponding elements throughout the several views, attention is first directed to FIG. 1, in which, for purposes of illustration, the hair grooming device is illustrated as a comb generally designated by the reference character 10. A brush, generally designated by the reference character 11 as specifically illustrated as a toothbrush for purposes of explanation of the instant invention, is detachably secured to comb 10.

Figure 2:
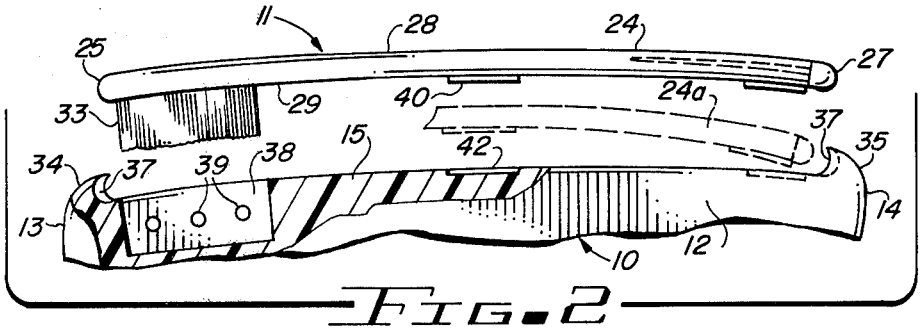
FIG. 2 is a fragmentary elevation view of the device of FIG. 1, and showing the brush separated from the hair grooming device.
Figure 4:
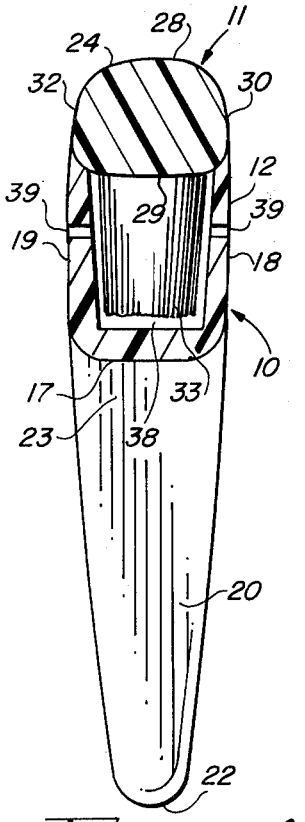
FIG. 4 is an enlarged vertical sectional view taken along the line 4—4 of FIG. 1.

Comb 10, in accordance with conventional practice in the art, includes an elongate backbone 12 having first and second ends 13 and 14, respectively. With further reference to FIGS. 2 and 4, it is seen that backbone 12 also includes upper and lower longitudinal edges 15 and 17, respectively, and spaced apart sides 18 and 19. A plurality of hair engaging elements, in the form of spaced apart teeth 20, depend from lower longitudinal edge 17. In accordance with conventional practice, each tooth 20 is tapered having a smaller tip 22 than root 23. Further, the extreme end teeth 20*a* may be of somewhat heavier construction than the intermediate piece 20.

Brush 11, as illustrated in FIG. 2, includes elongate handle element 24 having first end 25 and second end 27. As further illustrated in FIG. 4, handle element 24 includes upper and lower longitudinal edges 28 and 29, respectively, and side edges 30 and 32. Analogous to a conventional toothbrush, a plurality of bristles 33 arranged in a cluster depend from lower longitudinal edge 29 proximate first end 25.

In accordance with the immediate embodiment of the invention, means for detachably securing the brush to the comb includes a pair of spaced apart lugs, first lug 34 and second lug 35, upstanding from upper longitudinal edge 15 of backbone 12 proximate first and second ends 13 and 14, respectively. A pair of rounded sockets 37, 37 are carried in opposition by the lugs 34 and 35. Ends 25 and 27 of handle element 24 are rounded to be matingly received within the sockets 37. A well 38, extending into backbone 12 from upper longitudinal edge 15, is appropriately positioned and sized to receive the cluster of bristles 33. A plurality of openings 39 extend through sides 18 and 19 into well 38 and function as air vents for the passage of fresh air through bristles 33.

The length of handle element 24 as measured between the extremes of ends 25 and 27 corresponds to the distance between lugs 34 and 35 measured as the extreme distance between sockets 37. Brush 11 is detachably held in snap engagement with comb 11. In order to assemble or disassemble the combination, handle element 24 must be slightly bowed as illustrated by the partial broken outline 24*a*. Fabricated of plastic or other suitable material, handle element 24 can be readily flexed for this purpose as will be appreciated by those skilled in the art.

With particular reference to FIG. 4, it is seen that the width of handle element 24, the distance between side edges 30 and 32, is substantially equal to the width of backbone 12, the distance between sides 18 and 19. In the assembled configuration, as further seen in FIG. 1, lower longitudinal edge 29 of handle element 24 is in juxtaposition with the upper longitudinal edge 15 of backbone 12. To prevent side flexing of handle element 24 during carrying or use of the combination article, handle element 24 is provided with a tab 40 depending from lower longitudinal edge 29 and matingly receivable within recess 42 formed in upper longitudinal edge 15 of backbone 12.

Figure 3:
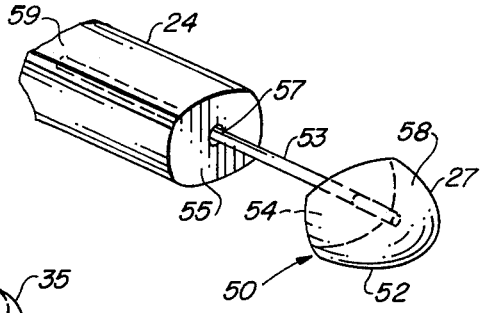
FIG. 3 is an enlarged fragmentary view of one end of the brush and showing the components thereof as they would appear when partially disassembled.

Turning now to FIG. 3, there is seen a pick, generally designated by the reference character 50 which may be carried by brush 11. Pick 50 includes a severed end portion 52 of handle element 24 which in turn functions as a handle for elongate shank 53 extending therefrom. In the assembled configuration, face surface 54 of severed end 52 abuts the narrow end surface 55 of handle element 24. Bore 57, extending inwardly from end surface 55, functions as a receptacle for receiving shank 53. Shank 53 includes end 58 held by severed end portion 52 and a free end 59 which may be pointed if desired.

Figure 5:
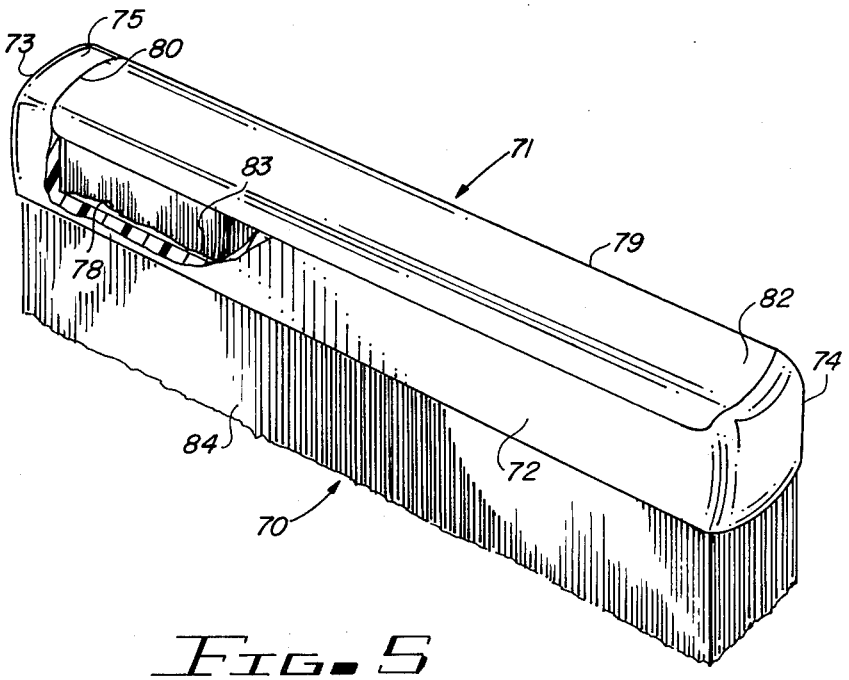
FIG. 5 is an enlarged perspective view, partially broken away for purposes of illustration, illustrating an alternate combination toilet article constructed in accordance with the teachings of the instant invention.

The alternate embodiment of the invention illustrated in FIG. 5 is generally analogous to the previously described embodiment. Illustrated is a hair grooming device 70 and a brush 71. Hair grooming device 70 includes backbone 72 having ends 73 and 74, lugs 75 and 77, well 78 and other features and elements, which although not specifically illustrated and denoted, that correspond to the features and elements of previously described backbone 12. Similarly, brush 71 includes elongate handle element 79 having ends 80 and 82 and carrying a cluster of bristles 83. The cluster of bristles is received within well 78 and ends 80 and 82 are held in snap engagement with lugs 75 and 77 as previously described.

Backbone 72 has a somewhat greater width than the width of backbone 12. The width of handle element 79 is correspondingly widened. Instead of a comb, however, hair grooming device 70 is in the form of a brush wherein the hair engaging elements take the form of a plurality of bristles 84.

Various changes and modifications to the embodiments of the instant invention herein chosen for purposes of illustration will readily occur to those skilled in the art. For purposes of illustration, the larger component has been illustrated as a hair grooming device such as comb 10 or brush 70. The smaller detachably securable component has been illustrated as a toothbrush having an elongate handle adapted to be grasped at one end and supporting a cluster of bristles at the other end. It is within the scope of the invention that the backbone of the larger component may support various engagement members especially adapted for shining shoes, brushing clothes, or dressing suede. The detachably securable component may have the cluster of bristles secured thereto at any desired location and which bristles may be variously fabricated for such varied chores as cleaning fingernails, removing lint from clothes and general purpose personal utility. The pick has various utility such as a toothpick or cleaning fingernails. To the extent that such modifications and variations do not depart from the spirit of the invention, they are intended to be included within the scope thereof which is assessed only by a fair interpretation of the following claims.

Having fully described and disclosed the present invention, and alternately preferred embodiments thereof, in such clear and concise terms as to enable those skilled in the art to understand and practice the same, the invention claimed is:

1. An improved toilet article adapted to be carried within a pocket or purse and for attending to selected personal grooming requirements, said toilet article comprising:

a hair grooming device including;

an elongate backbone having upper and lower longitudinal edges and a pair of spaced apart ends, each end having a lug upstanding from the upper longitudinal edge, each lug having a rounded socket;

means forming a well proximate one end of said backbone, said well extending inwardly from the upper longitudinal edge of said backbone;

a plurality of hair engaging elements depending from the lower longitudinal edge of said backbone;

a brush having an elongate handle element having upper and lower longitudinal edges and a pair of spaced apart ends shaped for mating engagement respectively with the sockets of the backbone and a plurality of bristles arranged in a cluster mounted on and depending from the lower longitudinal edge of the handle element proximate one end of said handle; and said brush being removably mountable on the backbone of the grooming device with the ends of the elongate handle element of the brush positioned in the sockets of the lugs of said backbone and with the cluster of bristles of the brush being positioned in the means forming a well of the backbone.

2. The improved toilet article of claim 1, wherein the lower longitudinal edge of said handle element is in juxtaposition with the upper longitudinal edge of said backbone when said brush is mounted on said hair grooming device.

3. The improved toilet article of claim 2, wherein the width of said handle element is substantially equal to the width of said backbone.

4. The improved toilet article of claim 3 which further includes:

a tab projecting from the lower longitudinal edge of the handle element; and a recess formed in the upper longitudinal edge of said backbone to matingly receive said tab to prevent side flexing of the handle element relative to the backbone when the brush is mounted on the backbone.

5. The improved toilet article of claim 4 in which the end of the handle element remote from the cluster of bristles mounted on the handle element is severable from the handle element, an elongate shank extending from the severable end of the handle element, and a bore in the handle element for receiving said shank.

6. The improved toilet article of claim 4 in which said brush is a toothbrush.

7. The improved toilet article of claim 6 in which the hair engaging elements depending from the lower longitudinal edge of the backbone are teeth of a comb.

8. The improved toilet article of claim 6 in which the hair engaging elements depending from the lower longitudinal edge of the backbone are bristles of a hair brush.

* * * * *